United States Patent [19]

Eckstein

[11] 4,311,172

[45] Jan. 19, 1982

[54] MULTI-LAYER SPLICED DRAINAGE SIEVE BELT AND METHOD FOR SPLICING SAME

[75] Inventor: Konrad Eckstein, Pfullingen, Fed. Rep. of Germany

[73] Assignee: Hermann Wangner GmbH & Co. KG, Reutlingen, Fed. Rep. of Germany

[21] Appl. No.: 111,499

[22] Filed: Jan. 11, 1980

[30] Foreign Application Priority Data

Jan. 25, 1979 [DE] Fed. Rep. of Germany ..... 2902880

[51] Int. Cl.[3] ..... D03D 25/00

[52] U.S. Cl. ..... 139/383 A; 162/DIG. 1; 24/38

[58] Field of Search ..... 139/383 A, 383 AA; 162/DIG. 1, 348, 349, 359; 24/38, 33

[56] References Cited

U.S. PATENT DOCUMENTS

| | | | |
|---|---|---|---|
| 1,948,411 | 2/1934 | Asten | 24/33 |
| 3,060,547 | 10/1962 | McBean | 139/383 AA X |
| 3,664,907 | 5/1972 | Rrice | 139/383 AA X |
| 4,141,388 | 2/1979 | Romanski et al. | 139/383 AA X |
| 4,186,780 | 2/1980 | Josef et al. | 139/383 AA |
| 4,267,226 | 5/1981 | Kohler | 24/38 |

FOREIGN PATENT DOCUMENTS

| | | |
|---|---|---|
| 1056436 | 4/1959 | Fed. Rep. of Germany . |
| 394788 | 12/1965 | Switzerland . |

*Primary Examiner*—Henry Jaudon

*Attorney, Agent, or Firm*—Sughrue, Mion, Zinn, Macpeak and Seas

[57] ABSTRACT

A multiple-layer spliced drainage sieve belt for use in paper pulp drying, in which the ends of respective layers of sieve fabric are spliced together separately, the seams being staggered along the length of the belt. Various types of seams may be utilized, among them a woven seam which does not differ from the other portions of the sieve belt.

12 Claims, 5 Drawing Figures

9
10
9
2
8
5
5
7
1
5
5
3
3

20
24
22

11
12
3
3

20
22'
24'

14
13
12
11
3
3

MULTI-LAYER SPLICED DRAINAGE SIEVE BELT AND METHOD FOR SPLICING SAME

BACKGROUND OF THE INVENTION

This invention relates to a multi-layered drainage sieve or fabric formed by splicing the ends together with a binder warp, and to a method of so splicing the ends.

German (OS) No. 2,455,184 discloses endless woven multi-layered drainage forming sieves for use in paper manufacturing. This German application also teaches that such drainage sieves may be woven in flat form and then joined end-to-end, but it does not disclose the method by which the ends of flat, multi-layered drainage sieves can be spliced together.

The problem of end-to-end connection does not arise with drainage sieves that have been woven endless to begin with. However, endless woven sieves have the disadvantage that the sieve length is predetermined and there are generally fewer possibilities for variation of the fabric count and the number of filling threads, so that the drainage capacity is only adjustable to a limited extent. Therefore, endless weaving requires considerable machinery to meet customers specifications. On the other hand, flat woven papermaking sieves can be produced on a single loom in any desired length. By varying the number of filling threads and thread diameters the customers specifications can be met more adequately. In general, these advantages of flat weaving outweigh the disadvantages inherent in connecting the ends of the sieve. There is thus a need for multi-layered, spliced drainage sieves and for a method of joining the ends thereof.

In principle, the ends of a multi-layered drainage sieve can be joined in the same manner as a single-layer drainage sieve, e.g. by simply machine sewing the ends together, either with a fabric connecting seam (German OS No. 2,700,390) or by a pin seam. In principle, it is possible to join the ends of a multi-layered drainage sieve with a woven seam as is commonly known for single-layer drainage sieves. A device for joining the ends of a single-layer drainage sieve is described in German AS No. 1,710,205. In joining the ends of a multi-layered sieve with a woven seam, the binder warp may even be inter-woven in the region of the seam. However, practice has proved that such a multi-layered woven seam is difficult to produce without any defects.

German OS No. 2,429,162 discloses a method for joining the ends of multi-layered sieves in which a plurality of zones are provided where the warp threads are freed from at least one weft layer to increase the flexibility of the seam which, in principle, is a pin seam. Multi-layered sieves which have been joined in this manner have the disadvantage that the drainage capacity in the seam region is substantially less than in the remaining sieve area.

German OS No. 2,707,705 describes a method for joining the ends of a multi-layered sieve in which free fabric ends of different layers are overlapped and joined by sewing, stapling, gluing or interlocking with a (Velcro) tape fastener. However, these modes of connection do not sufficiently ensure the absence of marks on the paper.

SUMMARY OF THE INVENTION

The object of this invention is to provide a multi-layered, spliced drainage sieve in which the drainage capacity in the seam region deviates as little as possible from the drainage capacity of the remaining sieve area, and to a method for joining the ends of a multi-layered flat woven drainage sieve.

This object is realized by disposing the seams of individual layers at offset locations in the sieve to ensure uniform drainage.

Preferably, at least one layer is joined or spliced by a woven seam. Such sieves or fabrics are especially suited for the manufacture of paper because the structure of the woven seam does not differ from that of the remaining sieve area, thus not allowing the seam to leave marks in the paper.

DETAILED DESCRIPTION OF THE PREFERRED EMBODIMENT

Figure 1:
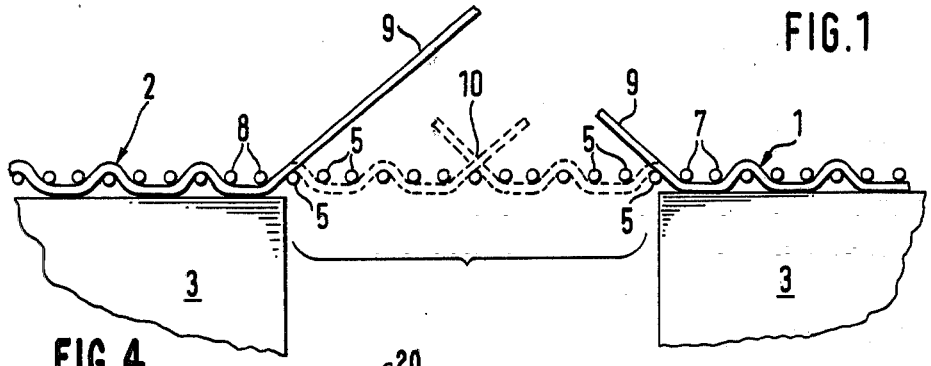
FIG. 1 illustrates the production of a woven seam in a single-layer drainage sieve.

The drainage sieve of the invention may be of any type of flat woven drainage fabric. It may be made in plain weave, satin weave or twill, or modifications thereof. The warp and filling threads may consist of any suitable material, e.g. of metal (phosphor bronze) or synthetic resin (polyester, polyamide). The warp and/or filling threads may consist of part synthetic resin and part metal. Furthermore, the drainage belt may be coated.

The drainage sieve or fabric consists of a plurality of layers or plies interconnected by a so-called binder warp. Each layer constitutes a complete fabric per se. The individual layers may differ in weave, size of pattern repetition, and/or material. The drainage belt shown in the drawings comprises two layers, but it may also comprise three or more layers. In general, the top or paper-supporting layer consists of a fabric with a greater number of warp and filling threads per centimeter and of finer threads. The diameter of the warp threads of a specific layer may differ from the diameter of the filling threads of the same layer. The warp threads of a layer need not have equal diameters; in the marginal region they may be thicker, or thick and thin warp threads may alternate. The same applies to the filling threads in a layer.

Hence, for the drainage belt of the invention any drainage fabric may be used which consists of a plurality of layers and which has been woven in flat form.

In the sieve of the invention the individual fabric layers are joined separately. Any method used to join the ends of a single-layer drainage sieve may be used to join the ends of the individual layers of the multi-layered belt. In particular, the individual layers may be spliced together according to the following methods:

1. Joining the ends by weaving (woven seam);
2. Sewing the two overlapping ends of a layer with a sewing machine;
3. Pin seam. Various embodiments of pin seams are known, for example, those in German patent applications (OS) Nos. 2,429,162; 2,542,905; and 2,700,390.

4. Heat sealing or gluing; the sealed seam may optionally also be sewn together with loop stitches;

5. Overlapping of the two ends without firm bonding.

The junctions (seams) of the individual layers may be in superposed relationship, but they are preferably mutually offset along the belt length. This results in an especially uniform drainage capacity.

The seam may extend perpendicularly to the longitudinal direction of the fabric. If the ends of a layer are joined by sewing machine, heat-sealing, gluing or the like, or if the ends of one layer overlap each other, the seam or junction may also extend obliquely with respect to the longitudinal direction of the fabric.

In general, to join the two ends of a layer it is necessary to remove the binder warp in a certain region of about 10–20 cm width, such as along the abutting edges of the belt ends. After the seaming or joining of the individual layers it is ordinarily not necessary to replace the binder warp in these regions.

When three or more layers are employed in drainage sieves, ordinarily not all the layers need be seamed or firmly joined together. Depending on the end use it may be sufficient to seam only two layers, e.g. the top and bottom layers. The top layer is preferably always seamed because it supports the paper pulp. The ends of the layers not firmly joined together may overlap or abut. If the ends of the bottom layer, i.e. the layer in contact with the rolls, are not firmly joined, they should preferably overlap. The end of the bottom layer pointing in the direction of advance is covered by the other fabric end so that it will not contact the rolls. The two ends may be of any desired length. However, the end pointing in the direction of advance will preferably be selected as short as possible and will be overlapped a few centimeters or more by the other fabric end.

Figure 4:
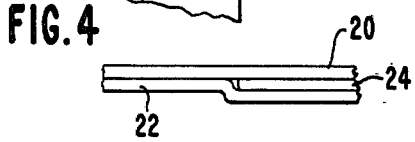
FIGS. 4 and 5 show two modified arrangements wherein the ends of one of the layers of a two-layered drainage sieve are not spliced.
Figure 5:
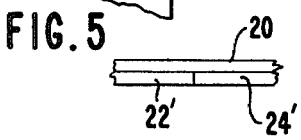

With two-layer belts, as shown in FIGS. 4 and 5 it is also possible to seam only one layer, and in general this will be the upper layer 20 since it carries the paper pulp. In order to prevent rapid wear of the lower layer an effective measure is to overlap the two unconnected ends 22 and 24 of the lower layer as shown in FIG. 4 such that the end pointing in the direction of advance lies between the upper layer and the end of the lower layer pointing opposite the direction of advance. In FIG. 5 the ends 22' and 24' abut each other.

Certain types of seams allow simultaneous joining of the ends of a plurality of layers with a single seam. Thus, for instance, the ends of two layers may be spliced simultaneously by sewing them together with a sewing machine. Another example is the method described in German patent application (OS) No. 2,429,162, by means of which a plurality of layers may be joined end-to-end by a single seam. The invention further provides spliced multi-layered drainage belts in which the ends of a corresponding number of groups of layers are joined by at least two seams. Each group of layers is joined end-to-end by a single seam.

If the ends of one layer are joined by a woven seam and those of another layer or layers are joined by another type of seam, e.g. a pin seam, it is advantageous to first make the non-woven seam and then to make the woven seam, because the width of a woven seam can be controlled more accurately. However, the production of the woven seam presents considerable difficulties, because the already produced seam obstructs the production of the woven seam. When the seams are offset relative to one another, the production of the woven seam is obstructed by the other fabric layers.

In order to explain the difficulties arising from the woven seam being the last one to be completed, it will now be described with reference to FIG. 1 how a woven seam is made in a single-layer fabric. At the fabric ends 1, 2 to be joined the warp threads are first exposed along a length of about 10 centimeters by removal of filling threads. The thus prepared ends of the fabric are clamped on a tenter table 3 so that the filler threads 7, 8 remaining in the fabric are disposed exactly parallel to each other at a predetermined distance of for example 8 cm. In general, the distance is an integral multiple of the weave pattern and is equal to or less than the length of the fringe-like ends of the warp threads (in this case 10 cm). Next, nearly all of the warp threads are removed from a strip previously cut off the fabric and having a width precisely corresponding to the distance between the fabric ends (in the present case 8 cm). The warp threads at one end of this strip are left in place to hold the filling threads together. The fringe-like warp thread ends 9 of the two fabric ends 1, 2 extending therefrom and the filling threads 5 of the previously cut-off fabric strip with removed warp threads are then interwoven. To this end a device may be used like that described in German patent application (AS) No. 1,710,205. The exposed filling threads are threaded into weaving shafts so that a shed can be formed with the exposed filling threads into which the fringe-like warp thread ends extending from the fabric ends are interwoven. Viewed with regard to their function in said device, the exposed filling threads form the warp and the fringe-like warp thread ends of the fabric form the filling or weft.

In this device a warp beam is not required because the warp threads left in the fabric strip hold the exposed filling threads together. The end of the fabric strip in which the warp threads have been left is secured by suitable clamping means. The already completed part of the woven seam performs the function of the cloth beam. Interweaving and stitching of the fringe-like warp thread ends 9 is done by hand. The two opposing warp thread ends 9 are pulled out of the fabric within the seam area either downwardly or upwardly, or one end downwardly and the other upwardly at a predetermined location, the so-called stitching point 10, and are then cut off. The locations where the warp threads are pulled out are disposed in a predetermined pattern within the woven seam. This pattern is essential to the tensile strength of the woven seam. The basic idea is to achieve wide overlapping of adjacent opposite warp thread ends. The stitching points 10 of adjacent warp thread ends therefore should be offset in the longitudinal direction of the sieve fabric.

Figure 2:
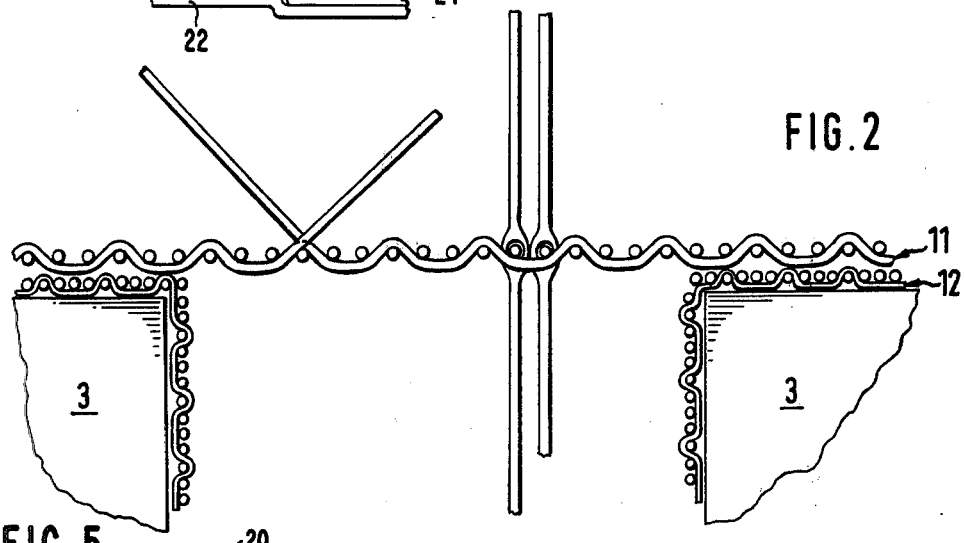
FIGS. 2 and 3 show the splicing of the ends of the first and second layers, respectively, of a two-layered drainage sieve.

In a two-layer sieve, the first layer 11 is joined as shown in FIG. 2, while the ends of the second layer 12 disposed beneath said first layer hang down. The first layer can be spliced together by a woven seam in a manner substantially as described for a single-layer sieve fabric in connection with FIG. 1.

Figure 3:
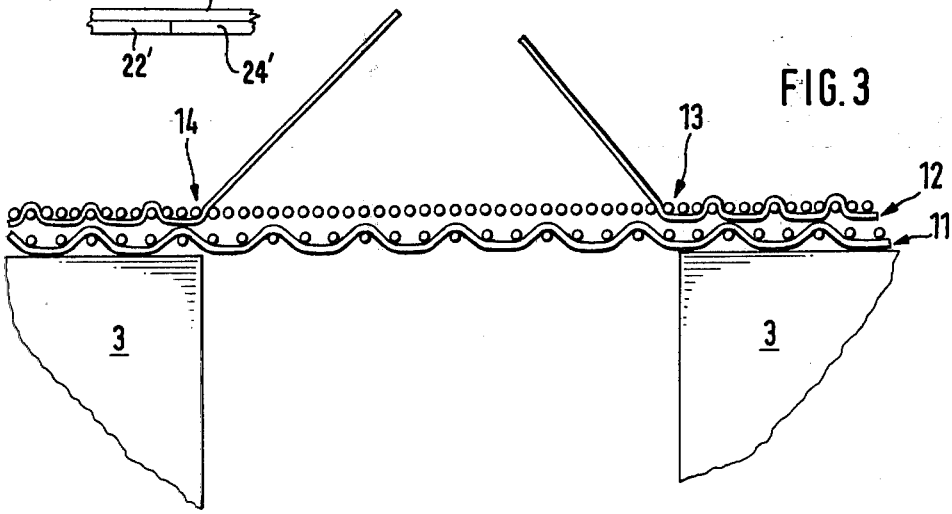

After the first layer 11 has been spliced by a woven seam, the fabric is turned over for better access to the second layer 12, which is then on top. This is shown in FIG. 3. The second layer 12 can no longer be spliced together by a woven seam in the same way as the first layer 11 because the harness cannot be arranged between the fabric ends 13, 14 to be joined. This difficulty can be overcome by arranging the harness beside the fabric rather than in the plane thereof and by lifting it out of the sieve plane so that it is on the side opposite the already seamed first layer 11. The distance of the harness from the sieve plane must be at least sufficient for the exposed filling threads 5 forming the shed to be disposed just in or slightly above the sieve plane when in their lowermost position. This is possible only in case of sieve widths up to about 80 cm. For wider sieves the harness cannot be arranged alongside. In such a case the harness must be arranged an accordingly greater distance away from the sieve plane so that the shaft frames will not contact the already seamed first layer 11 when in their lowermost position.

The procedure is similar when the woven seams are longitudinally offset relative to one another along the sieve length. When both layers are spliced together by woven seams, the procedure described above in connection with FIG. 3 must be followed for the production of both woven seams.

When the ends of two-layer drainage sieves are to be spliced the following seam combinations have proved to be especially advantageous:

1. Top layer: woven seam.
Bottom layer: pin seam with different material interlaced into the fabric. This alien material may be metal, polyester, polyamide and the like.
2. Top layer: woven seam.
Bottom layer: sewn together with a sewing machine.
3. Top layer: woven seam.
Bottom layer: sieve ends are welded together and then sewn with loop stitches of sewing thread.
4. (preferred embodiment)
Top layer: woven seam.
Bottom layer: not seamed at the lower layer a longer sieve end pointing opposite the direction of advance is left at the leading portion of the seam. This fabric portion covers the cut-off sieve end pointing in the direction of advance and extending from the trailing portion of the seam.

In cases 1 through 4 above the seams extend in the filling direction and can be either superposed or longitudinally offset.

5. The drainage sieve is cut diagonally and the ends of the top and bottom layers are sewn together respectively with loop stitches. The seams may either be disposed one above the other or offset.

6. Top layer: woven seam.
Bottom layer: sewn seam as described in German patent application (OS) No. 2,429,162 (pin seam in a plurality of zones where the warp threads have been freed from at least one filling layer) or as described in German patent application (OS) No. 2,700,390 (belt seam similar to spiral seams with hemstitch belt) or as described in German patent application (OS) No. 2,542,950 (back-woven pin seam).

7. One layer is glued or welded together, while the other is spliced with a woven seam.

When three or more layers are used similar combinations of various seams may be selected. The selection of a specific seam for a layer may also be dictated by the material from which said layer is made. Thus, for instance, not all materials are suited to be welded or glued together. Layers of polyamide may be welded together while this is not possible with polyester.

EXAMPLE

It will now be described how the ends of a two-layer sieve fabric can be joined by two superposed woven seams.

The upper layer has a four harness crow foot weave in which the warp threads have a diameter of 0.20 mm and the warp count is 28 per cm. The filling threads have a diameter of 0.24 mm and the filling count is 22 per cm.

The lower layer is made in three harness satin weave and consists of warp threads of 0.35 mm diameter and filling threads of 0.40 mm diameter. The warp is 14 per cm and the filling count is 11 per cm.

The binder warp is in plain weave and has a diameter of 0.17 mm. The binder warp count is 4.7 per cm.

A crosswise strip of 15 cm warp length is cut off one fabric end for an insert piece to be used later. The filling count at the two fabric ends and in the insert piece must be exactly identical. The binder warp between the two fabric layers is cut away and removed along a length of 20 cm leaving no remaining binder warp.

The ends of the lower layer of the sieve fabric are then woven together (woven seam) such that the seam width is about 6 cm in the warp direction. To this end the filling threads are removed from a region of 20 cm at the two ends of the lower layer, leaving warp thread fringes of 20 cm length. The sieve fabric is then mounted in a seaming device similar to that described in German patent application (AS) No. 1,710,205. A strip corresponding to the seam width of 6 cm is selected from the insert piece, said strip containing 65 filling threads and repeating the pattern at the layer ends. These 65 filling threads are now threaded into the harness of the seaming machine in three-harness satin weave. After shedding of the harness of the seaming machine the first warp thread fringes of the two layer ends may be interlaced into the opened shed and the warp thread fringes are stitched at a location near the first layer end, i.e. they are pulled out of the seam. After advancing the harness one step, the second warp thread fringes are inserted and pulled out at a stitching location relatively remote from the first layer end. The further warp thread fringes are inserted and stitched accordingly. After completion of the lower left woven seam the sieve fabric is removed from the seaming device, turned over so that the still unconnected layer is on top, and remounted in the machine.

The upper layer is then spliced together by precisely the same type of weave described in connection with what is now the lower layer, i.e. the filling threads are removed from the ends of the layer to be joined and the warp threads are removed from the insert piece. The filling threads of the insert piece are then threaded in four harness satin weave, with the number of inserted threads now being 128 so that the woven seam of the upper layer will have the same width as the woven seam of the lower layer.

Since the sieve fabric was set before the ends were joined together to thereby fix the crimps in the warp and filling threads, the warp thread fringes and the filling threads of the insert piece engage in the same fashion as those in the sieve fabric so that the weave pattern of the sieve fabric continues within the seam. Therefore, no seam marks are left in the paper produced by means of the drainage sieve belt.

After the warp fringes and filling threads are interlaced the warp thread ends protruding from the fabric are clipped off.

What is claimed is:

1. A multi-layered spliced drainage sieve belt, for use in paper drying facilities, which includes at least a top layer and a bottom layer interconnected by a binder warp, each of said layers being a complete fabric comprised of warp threads and filling threads and being flat woven so as to include ends which meet to form a junction with the ends of at least one of said layers being joined together by a woven seam.

2. Drainage sieve according to claim 1, wherein the junctions of the individual layers are mutually offset in the longitudinal direction of the sieve belt.

3. Drainage sieve according to claim 1, wherein the ends of all layers are joined together separately by woven seams.

4. Drainage sieve according to claim 1, wherein one side of one layer is adapted to support a paper and said warp threads in the woven seam of the paper-supporting layer terminate on the side thereof not supporting the paper.

5. Drainage sieve according to any one of claims 1, 2 or 4, wherein the ends of at least one layer abut each other while the ends of other layers are joined together.

6. Drainage sieve according to any one of claims 1, 2 or 4, wherein an end of the bottom layer facing in the direction of sieve advance overlaps the end of said bottom layer facing in the direction opposite sieve advance and is disposed between the latter and the other layers.

7. Drainage sieve according to claim 6, wherein the ends of said top layer are joined by a woven seam.

8. A method for splicing the ends of a multi-layered drainage sieve belt in which the layers are interconnected by a binder warp, and the respective layers are each a complete fabric comprised of warp threads and filling threads and are flat woven so as to include ends, comprising:

(a) joining the ends of one layer together in a known manner, and (b) joining the ends of a second layer together with a woven seam.

9. Method according to claim 8, in which in the production of the woven seam the warp threads on both ends of the second layer are exposed along a predetermined length by removal of the filling threads, the layer ends are clamped parallel and spaced apart, and the exposed warp threads are interlaced with filling threads by forming a shed from the filling threads with the aid of a harness, wherein the filling threads of an already formed portion of the woven seam extend from the sieve plane and are disposed relative to the sieve plane.

10. Method according to claim 9, wherein the filling threads of the already formed portion of the woven seam extend from the sieve plane such that the lowest of said filling threads are disposed in the sieve plane.

11. Method according to claim 9, wherein the filling threads of the already formed portion of the woven seam extend from the sieve plane such that the lowest of said filling threads are disposed above the sieve plane.

12. Method according to claim 9, wherein the angle at which the filling threads from the sieve plane is such that the harness will not contact any portion of any layer whose ends were previously spliced together.

* * * * *